United States Patent [19]

Cotton et al.

[11] 4,030,053

[45] June 14, 1977

[54] DISTRIBUTION TRANSFORMER SECONDARY CIRCUIT BREAKER HAVING CANTILEVERED CONTACTS

[75] Inventors: John F. Cotton, Athens, Ga.; Jack G. Hanks, Bethel Park; Raymond E. Wien, Penn Township, Westmoreland County, both of Pa.

[73] Assignee: Westinghouse Electric Corporation, Pittsburgh, Pa.

[22] Filed: Sept. 11, 1975

[21] Appl. No.: 612,527

[52] U.S. Cl. ..... 335/15; 335/165

[51] Int. Cl.[2] ..... H01H 77/02

[58] Field of Search ..... 335/6, 8, 15, 165, 185, 335/188, 191, 192, 194, 197

[56] References Cited

UNITED STATES PATENTS

| | | | |
|---|---|---|---|
| 2,127,813 | 8/1938 | Graves | 335/194 |
| 2,679,561 | 5/1954 | Thompson | 335/194 |
| 3,864,652 | 2/1975 | Zubaty et al. | 335/194 |
| 3,883,781 | 5/1975 | Cotton | 335/6 X |

*Primary Examiner*—George Harris
*Attorney, Agent, or Firm*—R. E. Converse, Jr.

[57] ABSTRACT

An oil filled distribution transformer having a secondary circuit breaker utilizing a cantilevered stationary contact which is engaged by a movable contact for completing a series circuit therethrough. The cantilevered exposed stationary contact, which is surrounded by insulating oil, allows the oil in the transformer to rapidly return to the contact area after circuit interruption providing for faster arc extinction. The movable contact can be a bridging contact which forms a circuit between the cantilevered stationary contact and a second stationary contact mounted above a support base. The movable bridging contact is spring biased toward an open position separated from the stationary contact, but with the circuit breaker in the normally closed position is held in engagement with the stationary contact by a latching mechanism which is responsive to a bimetal or magnetic trip to allow the circuit breaker to trip open during overload conditions. The front cantilevered contact is completely surrounded by oil. During circuit interruption the oil in the contact area vaporizes forming an arc bubble of gas. Exposing the contact to allow free flow of oil into the area of the arc bubble allows for faster arc extinction and circuit interruption under fault conditions.

11 Claims, 5 Drawing Figures

DISTRIBUTION TRANSFORMER SECONDARY CIRCUIT BREAKER HAVING CANTILEVERED CONTACTS

CROSS-REFERENCE TO RELATED APPLICATIONS

This application is related to U.S. patent application Ser. No. 496,800, entitled "An Improved Distribution Transformer Secondary Circuit Breaker", filed Aug. 12, 1974, now U.S. Pat. No. 3,983,454.

BACKGROUND OF THE INVENTION

1. Field of the Invention

This invention relates to circuit breakers of the type having a bimetal thermal trip element and more particularly to circuit breakers for distribution transformers to control moderate power distribution on feeder circuits. The disclosed circuit breaker is particularly adaptable for use with oil filled distribution transformers.

2. Description of the Prior Art

Transformers used in power distribution systems are generally associated with a protective device which prevents or limits current overload damage to the transformer and its associated apparatus. A completely self-protected transformer includes a circuit breaker on the secondary or low voltage side to protect against damage due to overload currents. The secondary circuit breaker disconnects the transformer from its load if the load current becomes dangerously high.

Commonly used circuit breakers incorporate a bimetal thermal trip and an instantaneous magnetic trip. For overload currents it is desirable that the circuit interruption be completed as rapidly as possible after initiation.

SUMMARY OF THE INVENTION

An oil-filled transformer utilizing a circuit interrupter, disposed in the oil for interrupting circuits through the transformer, having a cantilevered stationary contact, which is surrounded by oil, and a movable contact which engages the cantilevered stationary contact for completing the transformer's secondary circuit.

In one embodiment of the invention an oil-filled transformer has a circuit interrupter disposed within the transformer housing with a movable bridging contact which engages a pair of stationary contacts, one of which is cantilevered. The bridging contact is movable between an open position spaced from the pair of stationary contacts and a closed position engaging the stationary contacts to complete a series circuit through the transformer to a low voltage terminal located on the transformer housing. The circuit breaker operating mechanism is supported from a rigid base member. One of the stationary contacts is supported on a cantilever contact support extending away from the base member; the other stationary contact is supported above the base member. An elongated contact arm pivotable about an axis fixed with respect to the base member has a movable bridging contact attached to one end thereof. The elongated contact arm extends beyond the base member. The elongated contact arm is spring biased towards the open position, wherein the movable bridging contact is spaced from the pair of stationary contacts. When the circuit interrupter is closed, the bridging contact is held in engagement with the pair of stationary contacts by a latch. A bimetal-actuated trip is disposed in series in the circuit through the transformer so that when current flow therethrough exceeds an overload trip value the bimetal-actuated trip moves the latch to an unlatched position permitting the circuit interrupter to trip open. The bimetal is also responsive to the temperature of the surrounding oil and will deflect when the oil is heated for any reason. The disclosed circuit interrupter also includes a magnetic trip which instantaneously starts to trip the circuit breaker when current flow through the circuit breaker exceeds a high overload value. The magnetic trip, which can be a single piece of sheet steel, is disposed in close proximity to the bimetal to be drawn towards the bimetal when current flow through the bimetal exceeds the high overload value. As the magnetic trip is drawn towards the bimetal the latch opens, permitting the circuit breaker to trip open.

The disclosed secondary circuit breaker provides a pair of stationary contacts, one of which is cantilevered away from the support base so as to be surrounded by oil, which can be connected by a bridging contact completing a series circuit therebetween. The bridging contact is disposed at the end of an elongated contact arm which is pivotal about an axis fixed with respect to the base to move the bridging contact between a closed position completing an electric circuit through the pair of stationary contacts and an open position spaced from the pair of stationary contacts. The elongated contact arm in the closed position extends beyond the base portion. A primary latch means is connected to the elongated contact arm for latching the contacts in a closed position. A secondary latch means is provided for keeping the primary latch in the latched position. Bimetal actuating means responsive to current are provided for unlatching the secondary latch when current flow through the circuit breaker exceeds a predetermined overload trip value. An overcenter toggle which is spring biased toward a collapsed position is connected to the elongated contact arm and is held in the open center extended position by the primary latch when the circuit breaker is in the normal closed position. When the secondary latch is unlatched due to current overload in the circuit breaker, the primary latch moves to the unlatched position permitting the spring biased toggle to collapse, opening the circuit interrupter with a snap action. The disclosed circuit interrupter has an advantage over prior art circuit interrupters in that greater oil contact with the cantilevered stationary contact is provided yielding faster circuit interruption and superior cooling of the contact.

It is an object of this invention to teach a low voltage oil circuit interrupter utilizing a stationary cantilevered contact.

BRIEF DESCRIPTION OF THE DRAWINGS

For a better understanding of the invention reference may be had to the preferred embodiments exemplary of the invention shown in the accompanying drawings in which.

DESCRIPTION OF THE PREFERRED EMBODIMENTS

Figure 1:
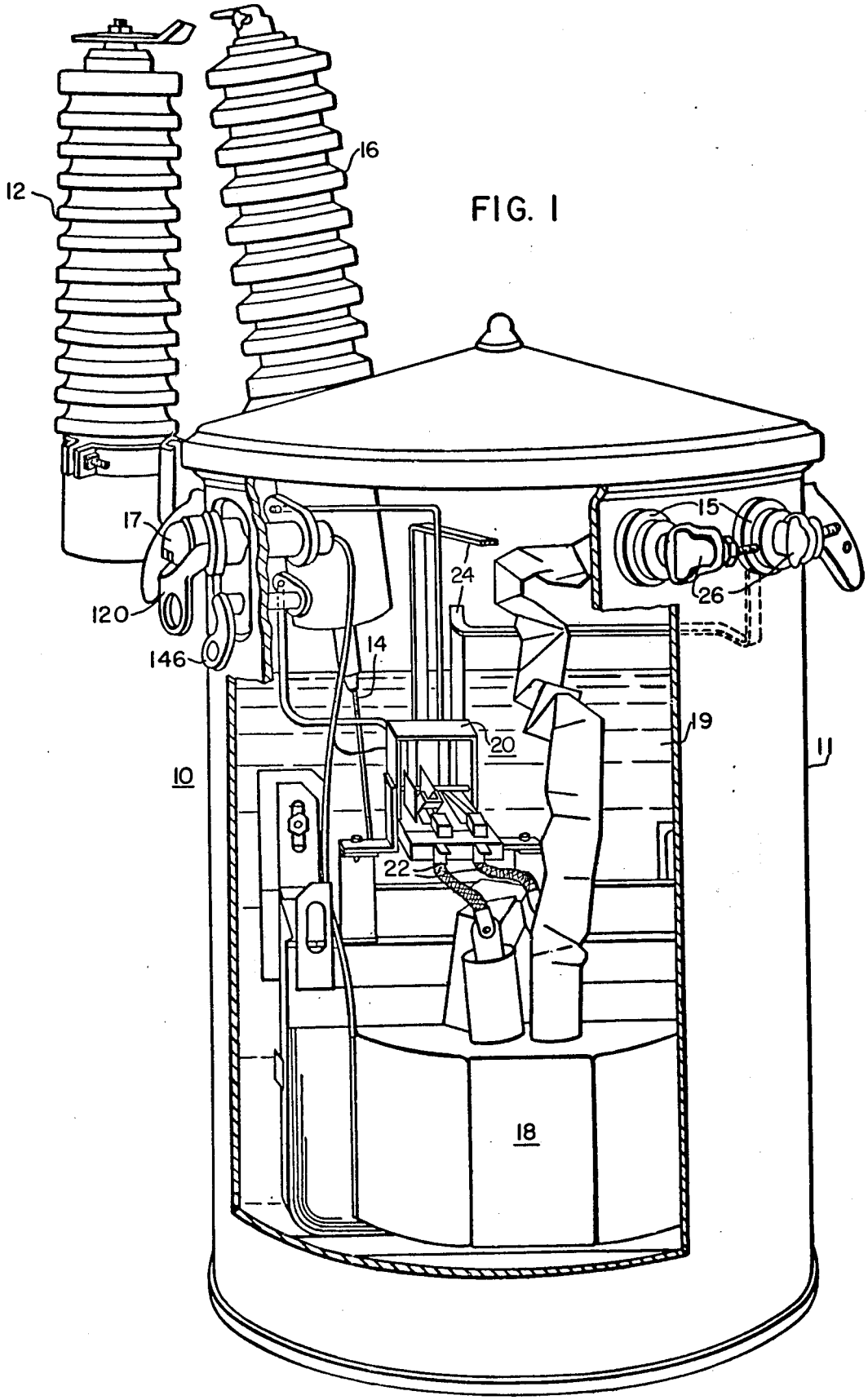
FIG. 1 is a perspective view of an oil filled distribution transformer utilizing the teaching of the present invention.
Figure 2:
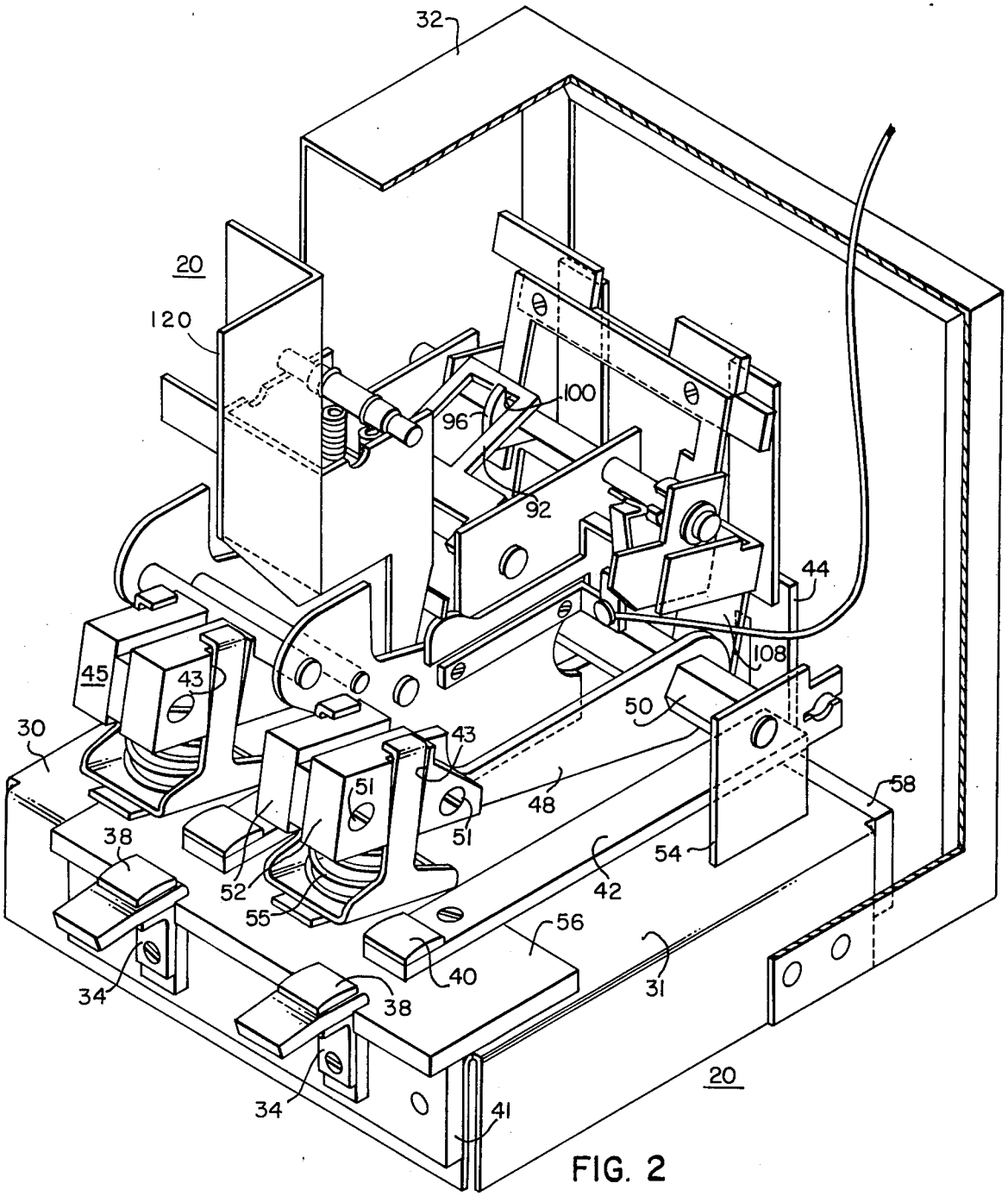
FIG. 2 is a perspective view of a secondary circuit interrupter for use on a distribution transformer utilizing the teaching of the present invention.
Figure 5:
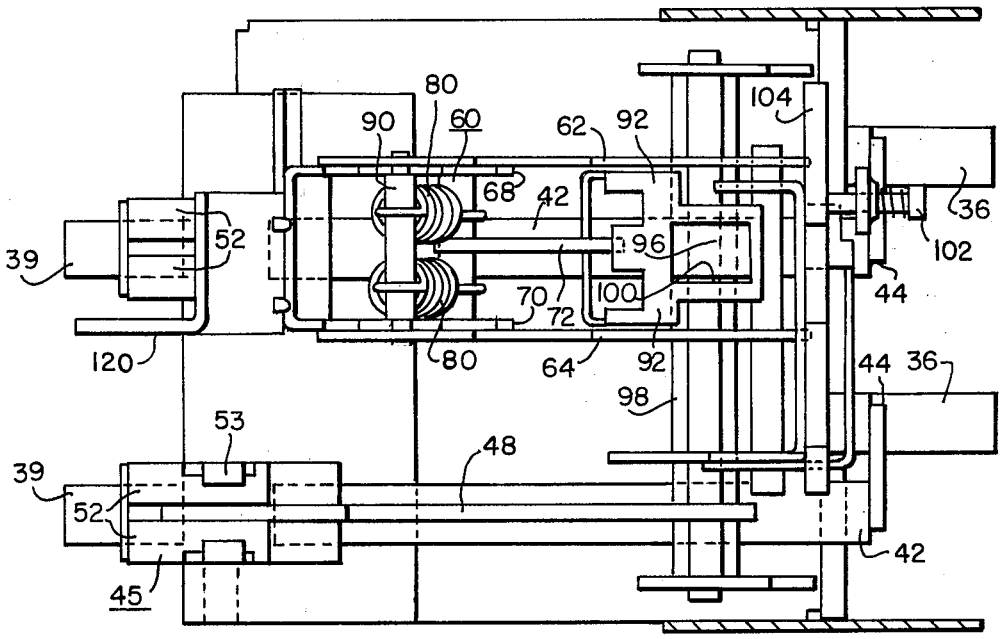
FIG. 5 is a top view of the circuit interrupter shown in FIG. 4.
Figure 3:
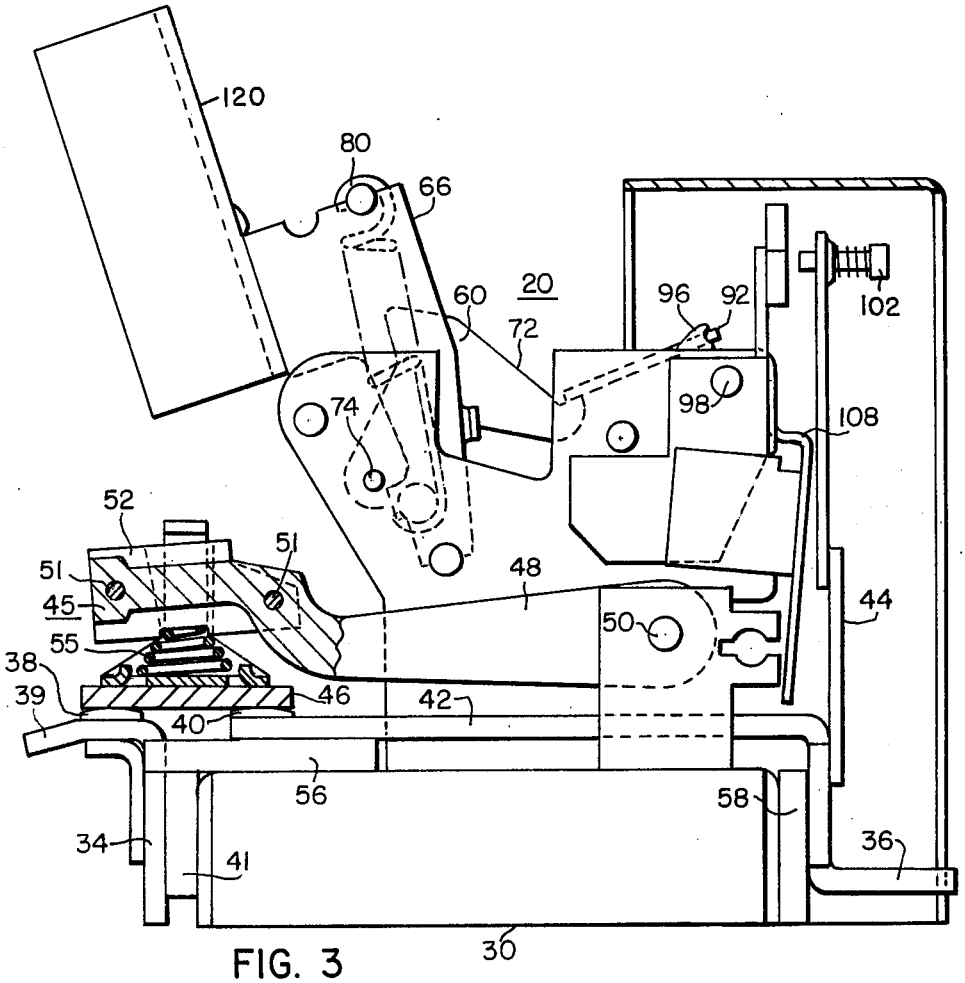
FIG. 3 is a side view of the circuit interrupter shown in FIG. 2 with the contacts in the closed position.
Figure 4:
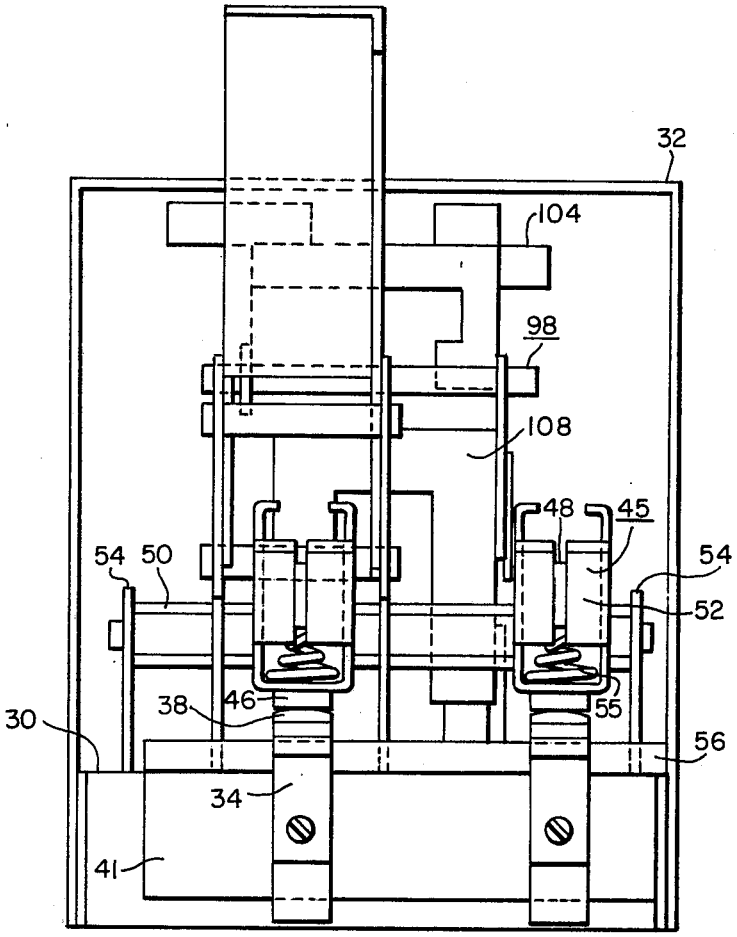
FIG. 4 is a front view of the circuit interrupter shown in FIG. 2.

Referring now the drawings and FIG. 1 in particular there is shown a pole-type completely self-protected transformer 10 including a circuit interrupter 20 utilizing the teaching of the present invention. The transformer 10 includes an enclosure or tank 11 with a lightning arrester 12 and a primary high voltage bushing 16 mounted thereon. Secondary bushings such as the low voltage bushings 15 are attached to enclosure 11 to which the transformer load is connected. A signal light 17 is mounted on the enclosure 11 and is electrically connected to the circuit breaker 20 to be actuated at a predetermined low overload value. The core and coil assembly 18 is secured inside the enclosure 11 with the circuit breaker 20 attached thereto. Required primary winding leads 14 extend from the core and coil assembly 18 through the appropriate high voltage bushing 16. The housing 11 is partially filled with an insulating liquid dielectric 19, such as transformer oil. The circuit breaker 20 and the core and coil assembly 18 are immersed in the insulating coil 19. Secondary connections 22 coming from the core and coil assembly 18 connect to input terminals on circuit breaker 20. Conductors 24 connect the output terminals of circuit breaker 20 to the low voltage bushings 15 mounted to the transformer tank 11. Appropriate loads can then be connected to the low voltage terminals 26 of the distribution transformer 10. Referring now to FIGS. 2–5 there are shown embodiments of circuit breaker 20 utilizing the teaching of the present invention. FIG. 2 shows a perspective view of a two pole circuit breaker 20 constructed in accordance with the present invention. The circuit breaker 20 is mounted on a metallic base 30 having a top flat planar surface 31. A cover 32 is provided partially surrounding the sensing and tripping elements of the circuit interrupter 20 to provide protection during handling. Secondary leads 22 of the core and coil assembly 18 are attached to incoming circuit breaker terminals 34 by suitable means such as brazing. Electrical conductors 24, disposed between the circuit breaker 20 and the low voltage transformer bushing 15, attach to circuit breaker 20 at terminals 36. Circuit breaker terminals 34 connect to stationary contacts 38. Stationary contacts 38 are disposed on cantilevered portions 39 of terminals 34. Each stationary contact support 34 is attached to an insulating member 41 which is supported on the side of base 30. Thus stationary contact 34 is supported away from base 30 and is generally surrounded by insulating oil 19. Circuit breaker terminals 36 connects to second stationary contacts 40 through electrical conductors 42 and a bimetal 44. Stationary contacts 38 and 40 of each pole are disposed in a spaced apart relationship with cantilever-supported contacts 38 being spaced from base 30 and surrounded by the insulating fluid 19. Bridging contacts 46 are provided which with the circuit breaker in the closed position complete an electrical connection between stationary contacts 38 and 40. Thus with the circuit interrupter 20 closed an electric circuit is completed from a terminal 34 through stationary contact 38, through bridging contact 46, through stationary contact 40, through electrical conductor 42, through bimetal 44, to circuit breaker terminal 36. Each bridging contact assembly 45 includes a movable bridging contact 46 attached to one portion thereof which, when the circuit interrupter is closed, completes the electrical circuit between stationary contacts 38 and 40. By locating stationary contact 38 cantilevered away from base 30, faster circuit interruption is attained after contact opening is initiated. That is, it is believed that the free flow of oil around stationary contact 38 provides for faster circuit interruption.

In the disclosed distribution transformer the bridging contact 46 is located at a lower level in the tank 11 than the bimetal 44. This is a most desirable feature since if, for any reason, a transformer should develop an oil leak the bimetal will be first to be exposed above the oil in the gas space and will heat up rapidly causing the breaker to trip while the contacts 38, 40 and 46 are still under oil. This sequence of operation is desirable since it prevents contact arcing in the volatile gas space above the reduced oil level.

Each pole of the circuit breaker 20 is provided with an elongated contact arm 48 which at one end is rigidly secured to a through shaft 50. Shaft 50, which can be a metallic member, connects together the elongated contact arms 48 of all poles of the circuit interrupter 20 for simultaneous movement. That is, the contact arms 48 are connected together through shaft 50 so they move in unison. The bridging assembly 45 is connected to the end of the elongated contact arm 48 opposite shaft 50. An insulating member 52 is provided at the end of contact arm 48 so that contact arm 48 is electrically insulated from the contact bridging assembly 45. A spring 55 is provided in contact assembly 45 to provide uniform contact pressure and proper seating of the bridging contact 46 on the stationary contacts 38 and 40. As can be seen from the drawings, when any one of the poles of the circuit interrupter 20 opens all the other poles must also open.

Through shaft 50 is rotatably supported by brackets 54 which are attached to the metallic base 30. Stationary contacts 38 and 40 are electrically insulated from base plate 30 by insulating sheet 56 which is secured to base plate 30. Terminal 36 is connected to insulating sheet 58 which is rigidly secured to base plate 30. Electrical conductor 42 is insulated from base plate 30 by insulating sheets 56 and 58 and transformer oil 19 which fills the open spaces in the circuit interrupter 20 during normal operation. Conductor 42 which is generally L-shaped has its short portion attached to one leg of bimetal 44. The other leg of bimetal 44 attaches to terminal 36. A single operating mechanism 60 is provided for operating all poles of the circuit interrupter 20. Operating mechanism, 60 is connected to one of the elongated contact arms 48 and as this contact arm 48 is moved, in response to the positioning of the operating mechanism 60, the other elongated contact arm 48, connected through shaft 50, also responds. The single operating mechanism 60 for all poles is mounted on side plates 62 and 64 which are securely attached to support base 30. The operating mechanism, which is described more fully in copending application Ser. No. 496,800, comprises a U-shaped operating member 66, the two legs of which are pivotally connected to the side plates. A primary latch 72 is provided and is pivotally connected to a shaft 74 disposed between the side plates. A pair of toggle links (not shown) are provided with one end of the toggle connected to the elongated contact arm 48 and the other end of the toggle connected to primary latch 72 and having multiple springs 80 connected between the knee of the toggle and the top of U-shaped member 66 for raising contact arm 48 with a snap action when primary latch 72 is released. A shaft 90 fits on top of U-shaped member 66 and is engaged by the upper end of springs 80. Primary latch 72 is releasably held in a latched position by secondary latch 92. When secondary latch 92 moves to the unlatched position primary latch 72 is released and rotates around shaft 74 due to the force of springs 80 collapsing the toggle and raising the elongated contact arm 48.

Secondary latch 92 is prevented from moving to the unlatched position when the breaker is closed by a cam surface 96 which is part of a trip bar mechanism 98. With the circuit breaker normally closed, a portion of secondary latch 92 rests against the cam surface 96. When the trip bar mechanism is rotated a predetermined angle counterclockwise, as viewed in FIG. 3, the cam surface 96 passes through opening 100 in secondary latch 92 permitting secondary latch 92 to rotate to the unlatched position, releasing primary latch 72 and tripping open the circuit breaker 20. Trip bar mechanism 98 is connected to be rotated by current responsive means when the current through the circuit breaker 20 exceeds a predetermined value.

Each pole of the circuit breaker 20 is provided with an individual trip device including a current responsive bimetal element 44, through which the load current of associated pole passes. That is, the bimetal element 44 is electrically connected in the circuit of the circuit breaker 20 in series relation with the breaker contacts 38, 40 and 46. The bimetal 44 is generally U-shaped. One leg of the bimetal 44 is connected to fixed conductor 42 and the other leg of bimetal 44 is connected to fixed terminal 36. Bimetal 44 is disposed to contact an insulating portion 104 of trip bar mechanism 98 with an adjusting screw 102 when bimetal 44 deflects. Upon occurrence of, for example, an overload of less than 500% of normal rated current, the bimetal element 44 is heated and deflects toward the trip bar mechanism 98. As the bimetal element deflects, due to the flow of current therethrough, the screw 102 engages the insulating sheet attached to trip bar mechanism 98, rotating the trip bar 98 counterclockwise to a tripped position releasing secondary latch 92 and tripping open the circuit interrupter 20. The cam portion 96 of trip bar mechanism 98 moves from under the latching surface 106 to release the secondary latch 92. Primary latch 72 then rotates around pivot 74 moving the line of action of the springs 80 to the left of toggle pivot knee causing the toggle to collapse and opens the circuit interrupter 20 with a snap action.

Electromagnetic means is also provided to instantaneously trip the breaker. The electromagnetic trip means comprises a ferromagnetic member 108 directly connected to trip bar mechanism 98, disposed in proximity to bimetal element 44. Ferromagnetic member 108 is formed from a single piece of sheet steel. Member 108 which is generally U-shaped for a two pole breaker has one of its legs disposed in proximity to the bimetal for each pole. Upon occurrence of a high overload current, of say for example, greater than 500% of normal rated current flowing through either bimetal 44, the associated leg of electromagnetic trip member 108 is drawn towards bimetal 44 in response to the overload current whereupon trip bar mechanism 98 rotates to trip open the circuit interrupter 20. Electromagnetic trip member 108 almost instantaneously trips open the circuit breaker 20 in the high overload conditions without moving bimetal 44. As electromagnetic element 108 is drawn towards bimetal 44 trip bar 98 rotates simultaneously to release secondary latch 92 causing the circuit breaker 20 to trip open. The breaker 20 opens and current flow through the bimetal ceases and electromagnetic member 108 returns with trip bar 98 to a tripped position. Trip member 108 can be made with additional legs to accommodate a various number of poles. Operating handle 120 is movable between an on position closing the circuit breaker 20 and an off position opening circuit breaker 20. The circuit breaker contacts 38, 40 and 46 are manually opened by clockwise movement of operating member 66, as operating handle 120 is moved to the off position. Clockwise movement of the operator 66 carries the line of action of the overcenter springs 80 to the right whereupon the force of springs 80 causes a collapse of the toggle, thereby moving the bridging contact 46 to the open position with a snap action. Contacts are closed by counterclockwise movement of the operator 66, as viewed in FIG. 3. This moves the line of action of the springs 80 across to the left, consequently the springs 80 actuate the toggle to its extended overcenter position, thereby moving the movable bridging contact 46 to the closed position with a snap action.

When the circuit interrupter 20 has tripped open, the primary latch 72 and the secondary latch 92 must be reset to a latched position before the circuit breaker can be closed. Relatching of the operating mechanism is effectuated by movement of the operator handle 120 beyond the off position. The circuit breaker 20 may then be closed by movement of the operating handle 120 to the one position causing the circuit breaker 20 to close in the previously described manner.

We claim:

1. An oil-filled transformer having a housing with a circuit interrupter switchable between an open position wherein the electrical connections through the transformer are open and a closed position wherein the electrical connections through the transformer are closed disposed within the housing beneath the oil level comprising:

a circuit interrupter base;

a pair of stationary contacts one of which is disposed above said circuit interrupter base and the other disposed above and away from said circuit interrupter base;

bridging contact means movable between an open position spaced from said pair of stationary contacts and a closed position engaging said pair of stationary contacts completing a series circuit therethrough;

spring biasing means biasing said bridging contact means away from said pair of stationary contacts;

latching means movable between a latched position holding said bridging contact means in engagement with said pair of stationary contacts and an unlatched position allowing said bridging contact means to move away from said stationary contact means in response to said spring biasing means; and bimetal actuating means supported from said circuit interrupter base so that transformer current flows therethrough and being cooperatively associated with said latch means to move said latch means to an unlatched position when current flow exceeds a trip level.

2. A transformer as claimed in claim 1 comprising:
an elongated contact arm with one end pivotal about an axis which is fixed with respect to said circuit interrupter base and having said bridging contact means connected to the opposite end thereof; and
an operating mechanism connected to said elongated contact arm for switching said circuit interrupter between open and closed positions, said operating mechanism cooperating with said latching means and said spring biasing means to pivot said elongated contact arm and switch said circuit interrupter to the open position when said latching means are moved to the unlatched position.

3. An oil-filled transformer having a current responsive circuit interrupter protecting the transformer secondary comprising:
a base defining a flat surface;
a stationary contact support insulatably supported from said base and extending away from said base;
a first stationary contact disposed on said stationary contact support away from said base;
a movable contact;
an elongated contact arm having said movable contact attached to one end thereof with the other end pivoted about an axis which is fixed with respect to said base, movable between a closed position wherein said stationary contact and said movable contact are in engagement and an open position wherein said stationary contact and said movable contact are spaced apart;
spring biasing means biasing said elongated contact arm to the open position;
latching means for latching said contact arm in the closed position; and
tripping means for unlatching said latching means when current flow through the transformer secondary exceeds a predetermined value.

4. An oil-filled transformer as claimed in claim 3 wherein:
said contact support is formed from an L-shaped member, one leg of which is attached to said base and the other end of which extends away from said base.

5. A transformer as claimed in claim 4 comprising:
a second stationary contact spaced away from said first stationary contact and being positioned above the flat surface of said base;
said movable contact briding said first stationary contact and said second stationary contact.

6. A transformer as claimed in claim 5 wherein:
said base is formed from metal; and,
insulation means are disposed between said stationary contact support and said second stationary contact for insulating said stationary contact support and said second stationary contact from said base.

7. A circuit interrupter for use in an insulating liquid comprising:
a flat base;
a first fixed contact supported from said flat base outside the confines defined by a perpendicular projection of said flat base;
a second fixed contact supported from and above said flat base within the confines defined by a perpendicular projection of said base;
bridging contact means supported for movement between a closed position engaging said first and second fixed contacts, to form a series connection therebetween, and an open position, separated from said first and second fixed contacts;
biasing means for biasing said bridging contact means to the open position;
latching means for latching said bridging contact means in the closed position; and
tripping means for unlatching said latching means when current flow through the circuit interrupter exceeds a predetermined value.

8. A circuit interrupter as claimed in claim 7 comprising an L-shaped contact support having a first leg supported from said base and having a second leg extending away from said base upon which said first fixed contact is disposed.

9. A circuit interrupter as claimed in claim 7 comprising:
an elongated metallic contact arm having a fixed end pivotable around an axis fixed with respect to said base and having said bridging contact means supported from the other free end thereof.

10. A circuit interrupter for use in an insulating oil environment comprising:
a box-shaped base member having a side portion and a flat planar top surface;
a stationary contact support insulated from and supported by said box-shaped base member having a cantilever portion which extends away from said box-shaped base member;
a stationary contact disposed on the cantilever portion of said stationary contact support;
a movable contact, extending beyond said box-shaped base member, movable between a first position engaging said stationary contact and a second position spaced apart from said stationary contact;
operating means supported from said box-shaped base member for moving said movable contact between the first position and the second position; and
tripping means connected to said operating means for causing said movable contact to move to the second position when current flow through said circuit interrupter exceeds a predetermined level.

11. A circuit interrupter as claimed in claim 10 comprising an elongated contact arm having one end pivotable by a fixed axis with respect to said box-shaped base member and having the movable contact supported from the other end thereof extending beyond said base member.

* * * * *